US005565127A

United States Patent [19]

Laufenberg et al.

[11] Patent Number: 5,565,127

[45] Date of Patent: Oct. 15, 1996

[54] SURFACTANT BASE FOR SOAPLESS LUBRICANTS

[75] Inventors: Alfred Laufenberg, Leobendorf, Austria; Birgit Winkelmann, Krefeld; Werner Strothoff, Rheinfelden, both of Germany

[73] Assignee: Henkel Kommanditgesellschaft auf Aktien, Duesseldorf, Germany

[21] Appl. No.: 295,804

[22] PCT Filed: Feb. 22, 1993

[86] PCT No.: PCT/EP93/00413

§ 371 Date: Nov. 9, 1994

§ 102(e) Date: Nov. 9, 1994

[87] PCT Pub. No.: WO93/18121

PCT Pub. Date: Sep. 16, 1993

[30] Foreign Application Priority Data

Mar. 2, 1992 [DE] Germany ..... 42 06 506.2

[51] Int. Cl.[6] ..... C10M 173/02; C10M 133/00

[52] U.S. Cl. ..... 508/220; 508/476; 508/508; 508/513

[58] Field of Search ..... 252/49.3, 51.5 R, 252/50, 34, 52 R

[56] References Cited

U.S. PATENT DOCUMENTS

| | | | |
|---|---|---|---|
| 3,346,495 | 10/1967 | Malec et al. | 252/49.3 |
| 4,113,645 | 9/1978 | DeSimone | 252/98 |
| 4,474,677 | 10/1984 | Foxlee | 252/98 |
| 4,521,321 | 6/1985 | Anderson et al. | 252/49.3 |
| 4,726,848 | 2/1988 | Murphy | 134/38 |
| 4,839,067 | 6/1989 | Jansen | 252/49.3 |
| 4,866,165 | 9/1989 | Lüders | 536/18.6 |
| 5,062,978 | 11/1991 | Weber et al. | 252/49.3 |
| 5,174,914 | 12/1992 | Gutzmann | 252/49.3 |
| 5,352,376 | 10/1994 | Gutzmann | 252/49.3 |
| 5,389,199 | 2/1995 | Awad et al. | 252/49.3 |

FOREIGN PATENT DOCUMENTS

| | | |
|---|---|---|
| 0510524 | 7/1980 | Australia . |
| 0044458 | 1/1982 | European Pat. Off. . |
| 0301298 | 2/1989 | European Pat. Off. . |
| 0372628 | 6/1990 | European Pat. Off. . |
| 2313330 | 10/1973 | Germany . |
| 3831448 | 3/1990 | Germany . |
| 3905548 | 9/1990 | Germany . |

*Primary Examiner*—Margaret Medley
*Attorney, Agent, or Firm*—Ernest G. Szoke; Wayne C. Jaeschke; Henry E. Millson, Jr.

[57] ABSTRACT

Soapless lubricant compositions, especially for use in the food and beverage industry, comprising an amphoteric compound, a tertiary amine and/or a salt thereof, and a nonionic surfactant which is one or more of an alkyl dimethylamine oxide or an alkyl oligoglycoside.

17 Claims, No Drawings

SURFACTANT BASE FOR SOAPLESS LUBRICANTS

BACKGROUND OF THE INVENTION

1. Field of the Invention

This invention relates to a new surfactant base for soapless lubricants known per se containing alkylamines and/or amphoteric compounds, optionally water and other auxiliaries and additives.

The invention also relates to the use of the lubricants as chain lubricants in the food industry. More particularly, the lubricants according to the invention are used for lubricating, cleaning and disinfecting automatic chain and belt conveyors which are used in the packaging of foods, preferably beverages, in glass and plastic bottles, cans, glasses, barrels, kegs, paper and cardboard containers and the like.

2. Statement of Related Art

The chain lubricants hitherto used for lubrication are based on the one hand on fatty acids in the form of their water-soluble alkali metal or alkanolamine salts or on fatty amines in the form of their organic or inorganic salts.

DE-A-23 13 330 describes soap-based lubricants containing aqueous mixtures of $C_{16-18}$ fatty acid salts and surfactants.

Apart from these soap-based lubricants, lubricants based on primary fatty amines are otherwise mainly used. Thus, DE-A-36 31 953 describes a process for lubricating chain-type bottle conveyors in bottling plants, more particularly in breweries, and for cleaning the conveyors with a liquid cleaner which is characterized in that the chain-type bottle conveyors are lubricated with conveyor lubricants based on neutralized primary fatty amines which preferably contain 12 to 18 carbon atoms and an unsaturated component of more than 10% and in that the bottle conveyors are cleaned with cationic cleaning preparations based on the quaternary ammonium compounds, such as alkyl trimethyl ammonium chloride, dialkyl dimethyl ammonium chloride and alkyl dimethyl benzyl ammonium chloride, or organic acids.

Finally, chain lubricants without any of the disadvantages mentioned above are known from the prior art. Thus, EP-A-0 044 458 describes lubricant preparations which are substantially free from fatty acid soaps and which in addition contain carboxylated nonionic surfactants and an acyl sarcosinate. The pH value of these products is in the range from 7 to 11 and, accordingly, is preferably in the neutral to alkaline range.

Finally, DE-A-38 31 448 relates to water-containing, soapless lubricant preparations which form clear solutions in water, to a process for their production and to their use in particular as lubricants for the transport of glass bottles or polyethylene terephthalate bottles. The substantially neutral water-containing lubricant preparations (pH 6 to 8) contain alkyl benzenesulfonates, alkoxylated alkanol phosphates and alkanecarboxylic acids, optionally in addition to typical solubilizers, solvents, foam inhibitors and disinfectants.

Unfortunately, the two products described above are attended by the following three disadvantages:

1. They are microbiologically unfavorable because they create excellent growth conditions for microorganisms.
2. In addition, they show minimal cleaning power.
3. Finally, their foaming behavior is difficult to control.

DE-A-39 05 548 describes lubricants containing at least one secondary and/or tertiary amine and/or salts of such amines.

Nowadays, beverages are often bottled in polyethylene terephthalate (PET) bottles. Returnable PET bottles have been successfully used in particular for beverages containing carbon dioxide, such as mineral waters and lemonade. During their transport in bottling plants, these bottles come into contact with chain conveyor lubricants. A more or less large part of the chain conveyor lubricant remains on the bottles, dries and results in partial damage to the bottles. More particularly, cracks, so-called stress cracks, have been found in the PET material. In extreme cases, this results in bursting of the bottles.

For this reason, soapless chain conveyor lubricants have hitherto been used almost exclusively for lubricating bottles, being tested by manufacturers for their particular suitability and then passed. Alkylamine-based chain conveyor lubricants generally known in the prior art which, as mentioned above, are widely used for the transport of other beverage containers apparently cause damage to the bottles.

DESCRIPTION OF THE INVENTION

Accordingly, the problem addressed by the present invention was to provide a chain conveyor lubricant which would meet application requirements to the extent that the so-called friction coefficient would be 0.1 to 0.12 or lower; would simultaneously clean, lubricate and disinfect; would be usable in low concentrations; would not damage the PET bottles; would be usable independently of water hardness and would be suitable in particular for PET and glass.

It has surprisingly been found that it is not the alkylamines themselves, but rather the auxiliaries typically used, such as nonionic surfactants, more particularly alkoxylated fatty amines, fatty alcohols, alkoxylated fatty alcohols, which cause more or less serious damage to returnable PET bottles.

The problem addressed by the present invention has been solved by the use of certain nonionic surfactants which meet all the requirements mentioned above that a chain conveyor lubricant is expected to satisfy.

The present invention relates to soapless lubricants based on amphoteric compounds, primary, secondary and/or tertiary amines and/or salts of such amines corresponding to general formulae (I), (IIa), (IIb), (IIIa), (IIIb), (IIIc), (IVa) and (IVb):

$$R-[NH-(CH_2)_n]_m-\overset{\overset{R^1}{|}}{\underset{\underset{R^2}{|}}{N^{\oplus}}}-R^3-COOM \quad (I)$$

$$R^4-NH-R^5 \quad (IIa)$$

$$R^4-N^+H_2-R^5\ X^- \quad (IIb)$$

$$R^4-NH-(CH_2)_3NH_2 \quad (IIIa)$$

$$R^4-NH-(CH_2)_3N^+H_3\ X^- \quad (IIIb)$$

$$R^4-N^+H_2-(CH_2)_3-N^+H_3\ 2X^- \quad (IIIc)$$

$$R^4-NR^7R^8 \quad (IVa)$$

and/or $$R^4-N^+HR^7R^8\ X^- \quad (IVb)$$

in which

R represents a saturated or mono- or polyunsaturated, linear or branched alkyl group containing 6 to 22 carbon atoms which may optionally be substituted by —OH, —$NH_2$, —NH—, —CO—, —$(CH_2CH_2O)_1$— or —$(CH_2CH_2CH_2O)_1$—, $R^1$ represents hydrogen, an alkyl group containing 1 to 4 carbon atoms, a hydroxyalkyl group containing 1 to 4 carbon atoms or a group —$R^3$COOM, $R^2$—only for the case where M is a negative charge—represents hydrogen, an alkyl group containing 1 to 4 carbon atoms or a hydroxyalkyl group containing 1 to 4 carbon atoms, $R^3$ is a saturated or mono- or polyunsaturated, linear or branched alkyl group containing 1 to 12 carbon atoms which may optionally be substituted by —OH, —$NH_2$, —NH—, —CO—, —$(CH_2CH_2O)_1$— or —$(CH_2CH_2CH_2O)_1$—, $R^4$ is a substituted or unsubstituted, linear or branched, saturated or mono- or polyunsaturated alkyl group containing 6 to 22 carbon atoms which may contain at least one amine, imine, hydroxy, halogen and/or carboxy group as substituent, a substituted or unsubstituted phenyl group which may contain at least one amine, imine, hydroxy, halogen, carboxy group and/or a linear or branched saturated or mono- or polyunsaturated alkyl group containing 6 to 22 carbon atoms as substituent(s), $R^5$ is hydrogen or—independently of $R^4$—has the same meaning as $R^4$, $X^-$ is an anion from the group consisting of amidosulfonate, nitrate, halide, sulfate, hydrogen carbonate, carbonate, phosphate or $R^6$—$COO^-$, where $R^6$ is hydrogen, a substituted or unsubstituted, linear or branched alkyl group containing 1 to 20 carbon atoms or alkenyl group containing 2 to 20 carbon atoms, which may contain a hydroxy, amine or imine group as substituent, or a substituted or unsubstituted phenyl group which may contain an alkyl group with 1 to 20 carbon atoms as substituent, and $R^7$ and $R^8$ independently of one another represent a substituted or unsubstituted, linear or branched alkyl group containing 1 to 20 carbon atoms or alkenyl group containing 2 to 20 carbon atoms, which may contain at least one hydroxy, amine or imine group as substituent, or a substituted or unsubstituted phenyl group which may contain an alkyl group with 1 to 20 carbon atoms as substituent, M is hydrogen, alkali metal, ammonium, an alkyl group containing 1 to 4 carbon atoms, a benzyl group or a negative charge, n is an integer of 1 to 12, m is an integer of 0 to 5 and l is a number of 0 to 5, containing alkyl dimethylamine oxides and/or alkyl oligoglycosides as nonionic surfactants.

In the context of the invention, preferred compounds corresponding to formula (I) are those in which:

R is a saturated or mono- or polyunsaturated linear alkyl group containing 10 to 18 carbon atoms, which may optionally be substituted by —CO—, more particularly an unsubstituted, saturated linear alkyl group containing 12 to 14 carbon atoms, $R^1$ is hydrogen, an alkyl group containing 1 to 3 carbon atoms or a group —$CH_2CH_2OH$, more particularly hydrogen or an alkyl group containing 1 to 3 carbon atoms, $R^2$ is hydrogen or an alkyl group containing 1 to 3 carbon atoms, $R^3$ is a methylene or dimethylene group, more particularly a methylene group, M is hydrogen or a negative charge, n=2 or 3, more particularly 2, m=0, 1 or 2, more particularly 0.

So far as their performance properties are concerned, the lubricant combinations according to the invention show a very high coefficient of friction, minimal foaming, a good cleaning effect and high compatibility with the skin. In addition to the positive properties mentioned, the following boundary conditions are satisfied: moderate foaming improves the lubricating effect in problem zones, such as rotary tables, changers, etc.; high substantivity and hence high lubricity, even under adverse operating conditions (for example under-conveyor lubrication); low toxicity; generally usable despite inadequacies of equipment; good cleaning effect; high capillary activity and film formation on surfaces; effective, even in the presence of organic impurities and acids or alkalis, and non-corrosive even as a concentrate.

When used in the beverage industry, the lubricant combinations according to the invention—in contrast to the chain lubricants hitherto used—are both independent of water quality and low-foaming, stable in storage at low temperatures, non-corrosive and particularly compatible with the environment and with the skin.

In principle, the compounds corresponding to general formula (I) and the process for their production are known from "Fettamine und Folgeprodukte", a Hoechst AG publication.

The following are examples of amphoteric compounds corresponding to general formula (I) which may also be used with advantage for the purposes of the present invention: dodecyl aminopropyl glycine, dodecyl di-(aminoethyl)-glycine, N-dodecyl-N,N-dipropyl glycine, N-cocos-N,N-dimethyl glycine (cocos=fatty alkyl groups containing 12 or 14 carbon atoms), N-hexadecyl-N,N-dimethyl glycine, N-soya-N,N-dimethyl glycine (soya=mono- and diunsaturated fatty alkyl groups preferably containing 18 carbon atoms), N-decyl-N,N-dimethyl glycine, dodecyl di-(aminopropyl)-glycine, $C_{10-18}$ fatty acid amidoethyl-N-hydroxyethyl glycine.

The lubricants according to the invention contain the compounds corresponding to general formulae (I) to (IV) in quantities of 1 to 99% by weight and preferably in quantities of 5 to 15% by weight, based on the formulation as a whole.

Accordingly, the lubricant combinations according to the invention may consist solely of the amphoteric compounds mentioned and the associated surfactant base. The present invention also relates to lubricant formulations in which the compounds corresponding to general formulae (I) to (IV) are present in only relatively small amounts, preferably in quantities of 5 to 15% by weight add more preferably in quantities of 10 to 12% by weight. In this case, the rest of the lubricant formulation preferably consists of water and, optionally, auxiliaries and/or additives and the surfactant base mentioned.

Other constituents of the lubricants are primary, secondary and/or tertiary amines and/or salts of such amines as described inter alia in German patent application DE-A-39 05 548 cited above.

Accordingly, the lubricants according to the invention may contain primary or secondary amines corresponding to general formula (IIa) or (IIb):

$$R^4—NH—R^5 \quad \text{(IIa)}$$

$$R^4—N^+H_2—R^5\ X^- \quad \text{(IIb)}$$

in which $R^4$ represents:

a substituted or unsubstituted, linear or branched, saturated or mono- or polyunsaturated alkyl group containing 6 to 22 carbon atoms which may contain at least one amine, imine, hydroxy, halogen and/or carboxy group as substituent, a substituted or unsubstituted phenyl group which may contain at least one amine, imine, hydroxy, halogen, carboxy group and/or a linear or branched, saturated or mono- or polyunsaturated alkyl group with 6 to 22 carbon atoms as substituent, and $X^-$ is an anion from the group consisting of amidosulfonate, nitrate, halide, sulfate, hydrogen carbonate, carbonate, phosphate or $R^6$—$COO^-$, where $R^6$ is hydrogen, a saturated, mono- or polyunsaturated, linear or branched, optionally —OH—, —$NH_2$— or —NH-substituted alkyl group with 1 to 20 carbon atoms or a corresponding alkenyl group with 2 to 20 carbon atoms or a substituted or unsubstituted phenyl group which may contain an alkyl group with 1 to 20 carbon atoms as substituent and $R^5$ has the same meaning as $R^4$ or is hydrogen.

Examples of secondary amines corresponding to general formulae (IIa) and (IIb) are dicocosamine, distearylamine, ditallow amine and corresponding salts, preferably the acetates.

The lubricants according to the invention may contain secondary diamines corresponding to general formula (IIIa), (IIIb) or (IIIc):

$$R^4—NH—(CH_2)_3NH_2 \quad \text{(IIIa)}$$

$$R^4—NH—(CH_2)_3N^+H_3\ X^- \quad \text{(IIIb)}$$

$$R^4—N^+H_2—(CH_2)_3—N^+H_3\ 2X^- \quad \text{(IIIc)}$$

in which $R^4$ and $X^-$ have the meanings defined above for general formulae (IIa) and (IIb).

The following are mentioned as examples of secondary diamines corresponding to general formulae (IIIa), (IIIb) and (IIIc): N-lauryl propylenediamine and N-tallow propylenediamine in the form of the free amines and in the form of the acetate salts.

Finally, the lubricants according to the invention may contain tertiary amines corresponding to general formulae (IVa) or (IVb):

$$R^4—NR^7R^8 \quad \text{(IVa)}$$

$$R^4—N^+HR^7R^8\ X^- \quad \text{(IVb)}$$

in which $R^4$ and $X^-$ have the meanings defined for general formulae (IIa) and (IIb) and $R^7$ and $R^8$ independently of one another represent:

a substituted or unsubstituted, linear or branched alkyl group containing 1 to 20 carbon atoms or alkenyl group containing 2 to 20 carbon atoms which may contain at least one hydroxy, amine or imine group as substituent, or a substituted or unsubstituted phenyl group which may contain an alkyl group with 1 to 20 carbon atoms as substituent.

Examples of tertiary amines corresponding to general formulae (IVa) and (IVb) are N,N-dipropyl-N-laurylamine, N,N-dimethyl-N-laurylamine, N,N-dimethyl-N-hexadecylamine, N,N-dimethyl-N-cocosamine, N,N-dimethyl-N-cetylamine and the corresponding acetate salts.

In a preferred embodiment of the invention, mixtures of secondary diamines corresponding to general formulae (III) and tertiary amines corresponding to general formulae (IV), for example a mixture of N-lauryl propylene diammonium acetate and N,N-dimethyl-N-lauryl ammonium acetate in a ratio by weight of 1:2 to 3:1 and preferably 2:1, are used in addition to the compounds corresponding to general formula (I).

Primary, secondary and tertiary amines corresponding to general formulae (II), (III) and (IV) shown above may be prepared by methods known from the literature and, in some cases, are available as commercial products, for example from Hoechst AG, Frankfurt am Main, Germany, under the name of GENAMIN® or from Lonza AG, Basel, Switzerland, under the name of LONZABAC® 12.

The ratio by weight of the compounds corresponding to general formula (I) to the amines corresponding to general formulae (II), (III) and/or (IV) is not critical. However, a ratio by weight of compounds corresponding to general formula (I) to the compounds corresponding to general formulae (II), (III) and/or (IV) in the range from 10:1 to 1:10 is preferred, a ratio of 5:1 to 1:1 being particularly preferred. The ratios by weight mentioned above are based on the sum total of the compounds (II), (III) and (IV) optionally used individually.

In addition, the lubricant combinations according to the invention may contain as auxiliaries solubilizers for obtaining a homogeneous in-use solution with clear solubility in water. Examples of such solubilizers are alcohols, polyalcohols, ethers or polyethers, more particularly isopropanol, butyl glycol, butyl diglycol or ethylene glycol ether. The quantity of solubilizer to be used in each individual case will be determined by the betaine used; in each individual case, the expert will determine the necessary quantity of solubilizer by trial and error. Additions of solubilizer of 1 to 20% by weight, based on the formulation as a whole, will generally be sufficient.

In one preferred embodiment of the present invention, the alkyl dimethylamine oxides to be used have a chain length of 10 to 18 carbon atoms and, more particularly, 12 to 14 carbon atoms in the alkyl group. The alkyl chains may be linear or branched, saturated, mono- or polyunsaturated.

Alkyl oligoglycosides in the context of the invention are preferably compounds corresponding to formula (V):

$$R^1—O—(G)_p \quad \text{(V)}$$

in which $R^1$ is an alkyl group containing 4 to 22 carbon atoms, (G) is a sugar unit containing 5 or 6 carbon atoms and p is a number of 1 to 10.

Alkyl oligoglycosides derived from aldoses and ketoses are preferred, those derived from glucose being particularly preferred by virtue of the ready availability of glucose. Accordingly, preferred alkyl oligoglycosides are alkyl oligoglucosides.

The index p in general formula (V) indicates the degree of oligomerization (DP degree), i.e. the distribution of monoglycosides and oligoglycosides, and is a number of 1 to 10. Whereas p in a given compound must always be an integer and, above all, may assume a value of 1 to 6, the value p for a certain alkyl oligoglycoside is an analytically determined calculated quantity which is mostly a broken number. Alkyl oligoglycosides with an average degree of oligomerization p of 1.1 to 3.0 are preferred, alkyl oligoglycosides with a degree of oligomerization of less than 1.7 and, more particularly, between 1.2 and 1.4 being particulary preferred.

The alkyl group $R^1$ may be derived from primary alcohols containing 4 to 22, preferably 8 to 16 and more preferably 8 to 10 carbon atoms. Typical examples are butanol, caproic alcohol, caprylic alcohol, capric alcohol, lauryl alcohol, myristyl alcohol, cetyl alcohol, stearyl alcohol, arachyl alcohol, behenyl alcohol and technical mixtures thereof based on natural fats and oils, for example palm oil, palm kernel oil, coconut oil or beef tallow.

Alkyl oligoglycosides are known substances which may be obtained by the relevant methods of preparative organic chemistry. European patent application EP-A-0 301 298 is cited as representative of the extensive literature available on their structure and synthesis.

In general, quantities of the surfactants mentioned above of 1 to 10% by weight, based on the formulation as a whole, are sufficient for wetting the chains and plate-type conveyor belts. The amine oxides and the alkyl oligoglycosides may be used individually or in the form of mixtures.

Known auxiliaries are, for example, alkoxylated fatty amines, fatty alcohols or alkoxylated fatty alcohols. Unfortunately, these surfactants have the disadvantage that they promote significant stress cracking in PET bottles. Accordingly, they are preferably not used for the purposes of the present invention. However, if they are still to be used in spite of this, they should be used in very small amounts.

The lubricants according to the invention preferably have a pH value in the range from 4 to 11 and more preferably in the range from 6 to 9. If the pH value of the lubricant is not already in this range, it may be adjusted to the required value by addition of an acid, preferably an acid bearing the anion $X^-$ defined above, for example with acetic acid.

In the interests of optimal dosing, the lubricant combinations advantageously have a dynamic viscosity of less than 300 mPa.s, preferably less than 150 mPa.s and more preferably in the range from 5 to 100 mPa.s, as measured at 20° C. There is generally no need for the viscosity to be separately adjusted to the values mentioned. If necessary, however, it may be adjusted to those values by addition of suitable quantities of the preferred diluent, water, or a solubilizer.

The lubricants according to the invention may be prepared simply by mixing the components with water, optionally with addition of the auxiliaries and/or additives mentioned.

Finally, the present invention relates to the use of lubricants of the type described above as chain lubricants in the food industry, more particularly for automatic chain and belt lubrication systems. For this purpose, the lubricants according to the invention are generally diluted with water. The resulting aqueous in-use solutions generally contain 0.01% by weight of compounds corresponding to general formulae (I) to (IV), preferably 0.01 to 0.2% by weight and more preferably 0.02 to 0.04% by weight of these compounds and 0.1 to 1% by weight of the above-mentioned surfactants according to the invention.

In contrast to standard soap products, the products according to the invention do not cause any stress cracking and, accordingly, may readily be used for PET and PC containers (PET=polyethylene terephthalate, PC= polycarbonate). Neutral pH values are particularly preferred for concentrates which form clear solutions in water. This is because, in the concentration required for chain and belt lubrication, the lubricants according to the invention are also suitable for cleaning empties and also machines and machine parts.

In addition, the centralized foam systems in the food industry are partly equipped with permanently installed automatic systems which, after or during breaks in a production sequence, automatically clean the outsides of fillers, cylindroconical fermentation and storage tanks, small conveyor belts and other machines and installations.

The lubricants according to the invention may also be used with considerable advantage for this purpose.

Accordingly, the present invention also relates to the use of lubricants of the type described above for disinfecting and cleaning empties, machines and installations in the food and beverage industry.

EXAMPLES

The present invention is illustrated by the following Examples. Examples 1 and 2 according to the invention show the resistance to friction and foaming behavior of lubricant formulations according to the invention. Examples 1 to 3 which relate to known products are Comparison Examples.

In the following formulation examples, all percentages are by weight.

The PET bottles are filled with water containing carbon dioxide (4.5% by volume $CO_2$) and are sealed accordingly. The bottles are dipped into the substance to be tested (see Table 1) at their lower ends and stored for 72 hours at 38° C. The bottles are then sampled (from "no stress cracks" to "bottle destroyed").

The tests for measuring resistance to friction (hereinafter referred to in short as the "friction coefficient") were carried out under the following conditions on a pilot-scale bottle conveyor:

Measurement of the friction coefficient of 20×0.5 liter "Euro" beer bottles filled with water as tensile stress using a dynamometer.

Speed of bottle conveyor: approx. 1 m/s

Spraying of the bottle conveyor with 0.4% by weight conveyor lubricant solution as specified in the Examples.

Spraying capacity of the nozzles: 4 l/h, one nozzle per conveyor.

The friction coefficient "μ" shown in the following is the quotient of the measured tensile stress for a bottle to the weight of the bottle in grams.

In addition, the products were tested with hard water (16° d) in accordance with the provisions of DIN 53 902.

Foaming behavior is classified as follows:

0=foam-free

1=occasional foam bubbles

2=slight foaming, not troublesome

3=foaming, troublesome

4=intensive foaming, unacceptable, foam under the conveyor

For adequate lubrication, the friction coefficient should be 0.10 to 0.12 or lower. If it exceeds 0.15, there is a significant deterioration in the lubricating effect and hence in satisfactory transport.

The clear solubility in water of the in-use solutions should be guaranteed even over prolonged test periods in order to avoid deposits in ball valve filters, nozzles, the spray and distribution system, the conveyor and the articles being conveyed.

Foaming should be minimal because excessive foam not only affects the automatic bottle inspector and factory safety (danger of slipping), it can also soften labels and enter the as yet uncapped containers. In addition, the friction coefficient is adversely affected by excessive foaming.

TABLE 1

| | |
|---|---|
| Cocosfatty amine + 12 EO | Average cracks |
| Oleylamide + 5 EO | Numerous cracks |
| 2-Hydroxyfatty alcohol ethoxylate | Numerous cracks |
| Oleyl cetyl propylene glycol ether | Numerous cracks |
| Oleyl cetyl alcohol + 5EO | Numerous cracks |
| Alkyl benzenesulfonate | No cracks |
| Cocosalkyl dimethylamine oxide | No cracks |
| $C_{8-10}$ glycoside$_{n=1.6}$ (70% active substance) | Hardly any cracks |
| $C_{8-10}$ glycoside$_{n=1.4}$ (60% active substance) | No cracks |
| $C_{8-10}$ glycoside$_{n=1.7-1.8}$ | Hardly any cracks |

Anionic surfactants, such as alkyl benzenesulfonate, cannot be incorporated in the cationically reacting alkylamine-based chain lubricants which leaves only amine oxides and alkyl polyglucosides for use in corresponding chain lubricants.

Example 1

6% Cocospropylene diammonium acetate
6% Cocosdipropylene triammonium acetate
3% Cocosalkyl dimethylamine oxide
85% Water
Friction coefficient: 0.14
Foaming behavior: foaming
Suitability: few cracks
Clear solubility in water: absolutely clear Example 2

6% Cocospropylene diammonium acetate
6% Cocosdipropylene triammonium acetate
3% $C_{8-10}$ glycoside$_{n=1.4}$ (60% active substance)
85% Water
Friction coefficient: 0.10
Foaming behavior: moderately foaming
Suitability: no cracks
Clear solubility in water: absolutely clear Comparison Example 1

8% Lauryl propylene diammonium acetate
4% N,N-dimethyl-N-lauryl ammonium acetate
88% Water
Friction coefficient: 0.10
Foaming behavior: non-foaming
PET suitability: few cracks
Clear solubility in water: opaque Comparison Example 2

6% Cocospropylene diammonium acetate
6% Cocosdipropylene triammonium acetate
88% Water
Friction coefficient: 0.10
Foaming behavior: low-foaming
PET suitability: no cracks
Clear solubility in water: slightly opaque Comparison Example 3

6% Cocospropylene diammonium acetate
6% Cocosdipropylene triammonium acetate
3% Cocosfatty amine+12EO
85% Water
Friction coefficient : 0.11
Foaming behavior: low-foaming
PET suitability: serious cracks
Clear solubility in water: absolutely clear

We claim:

1. A soapless lubricant composition consisting essentially of:

A) at least one amphoteric compound of the formula $$R-(NH-(CH_2)_n)_m-\overset{R^1}{\underset{R^2}{N^{\oplus}}}-R^3-COOM \quad (I)$$

wherein

R is a saturated or mono- or polyunsaturated, linear or branched alkyl group containing 6 to 22 carbon atoms, which may optionally be substituted by —OH, —$NH_2$, —NH—, —CO—, —$(CH_2CH_2O)_l$— or —$(CH_2CH_2CH_2O)_l$—, where l is a number of 0 to 5, $R^1$ is hydrogen, an alkyl group containing 1 to 4 carbon atoms, a hydroxyalkyl group containing 1 to 4 carbon atoms, or a group—$R^3$COOM, where $R^3$ and M have the meanings given below, $R^2$ is hydrogen, an alkyl group containing 1 to 4 carbon atoms, or a hydroxyalkyl group containing 1 to 4 carbon atoms, wherein the $R^2$ group is only present where M is a negative charge, $R^3$ is a saturated or mono- or polyunsaturated, linear or branched alkyl group containing 1 to 12 carbon atoms, which may optionally be substituted by —OH, —$NH_2$, —NH—, —CO—, —$(CH_2CH_2O)_l$— or —$(CH_2CH_2CH_2O)_l$, where l has the meaning given above, n is an integer of 1 to 12, m is an integer of 0 to 5, and M is hydrogen, an alkali metal, ammonium, an alkyl group containing 1 to 4 carbon atoms, a benzyl group, or a negative charge; and/or B) at least one amine of the formulae:

$$R^4—NH—R^5 \quad (IIa)$$

$$R^4—N^+H_2—R^5\ X^- \quad (IIb)$$

$$R^4—NH—(CH_2)_3NH_2 \quad (IIIa)$$

$$R^4—NH—(CH_2)_3N^+H_3\ X^- \quad (IIIb)$$

$$R^4—N^+H_2—(CH_2)_3—N^+H_3\ 2X^- \quad (IIIc)$$

$$R^4—NR^7R^8 \quad (IVa)$$

$$R^4—N^+HR^7R^8\ X^- \quad (IVb)$$

wherein $R^4$ is a substituted or unsubstituted, linear or branched, saturated or mono- or polyunsaturated alkyl group containing 6 to 22 carbon atoms, which may contain at least one amine, imine, hydroxy, halogen and/or carboxy group as a substituent, a substituted or unsubstituted phenyl group which may contain at least one amine, imine, hydroxy, halogen, carboxy group and/or a linear or branched saturated or mono- or polyunsaturated alkyl group containing 6 to 22 carbon atoms as a substituent, $R^5$ is hydrogen or, independently of $R^4$, has the same meaning as $R^4$, $X^-$ is an anion from the group consisting of amidosulfonate, nitrate, halide, sulfate, hydrogen carbonate, carbonate, phosphate or $R^6$—$COO^-$, where $R^6$ is hydrogen, a substituted or unsubstituted, linear or branched alkyl group containing 1 to 20 carbon atoms or alkenyl group containing 2 to 20 carbon atoms which may contain a hydroxy, amine or imine group as a substituent, or a substituted or unsubstituted phenyl group which may contain an alkyl group with 1 to 20 carbon atoms as a substituent, and $R^7$ and $R^8$ independently of one another represent a substituted or unsubstituted, linear or branched alkyl group containing 1 to 20 carbon atoms or alkenyl group containing 2 to 20 carbon atoms, which may contain at least one hydroxy, amine or imine group as substituent, or a substituted or unsubstituted phenyl group which may contain an alkyl group with 1 to 20 carbon atoms as a substituent; and C) at least one nonionic surfactant selected from the group consisting of an alkyl dimethylamine oxide and an alkyl oligoglycoside wherein the quantity of component A) plus component B) is present therein in from about 1 to about 99% by weight, and the quantity of component C) is present therein in from about 1 to about 10% by weight, the above quantities being based on the weight of the lubricant.

2. The lubricant of claim 1 wherein in A) in formula I:

R is a saturated or mono- or polyunsaturated linear alkyl group containing 10 to 18 carbon atoms, which may optionally be substituted by —CO—, $R^1$ is hydrogen, an alkyl group containing 1 to 3 carbon atoms or the group —$CH_2CH_2OH$, $R^2$ is hydrogen or an alkyl group containing 1 to 3 carbon atoms, $R^3$ is a methylene or dimethylene group, M is hydrogen or a negative charge, n=2 or 3, and m=0, 1 or 2.

3. The lubricant of claim 1 wherein in formula I:

R is an unsubstituted, saturated linear alkyl group containing 12 to 14 carbon atoms, $R^1$ is hydrogen or an alkyl group containing 1 to 3 carbon atoms, $R^3$ is a methylene group, n=2, and m=0.

4. The lubricant of claim 1 wherein the quantity of component A) plus component B) is from about 5 to about 15% by weight.

5. The lubricant of claim 4 wherein said quantity of component A) plus component B) is from about 10 to about 12% by weight.

6. The lubricant of claim 1 wherein the lubricant composition also contains water.

7. The lubricant of claim 1 wherein the ratio by weight of component A) to component B) is in the range of from about 10:1 to about 1:10.

8. The lubricant of claim 7 wherein said ratio is in the range of from about 5:1 to about 1:1.

9. The lubricant of claim 1 wherein the pH of the lubricant is from about 4 to about 11.

10. The lubricant of claim 9 wherein said pH is from about 6 to about 9.

11. The lubricant of claim 1 wherein the lubricant has a dynamic viscosity in the range of from about 5 to about 100 mPa.s at a temperature of 20° C.

12. The lubricant of claim 1 wherein in component c) the alkyl dimethylamine oxide has a linear or branched, saturated, mono- or polyunsaturated alkyl group containing 10 to 18 carbon atoms.

13. The lubricant of claim 12 wherein said alkyl group in the alkyl dimethylamine oxide contains from 12 to 14 carbon atoms.

14. The lubricant of claim 1 wherein in component c) the alkyl oligoglycoside has the formula:

$$R^1—O—(G)_p \qquad (V)$$

wherein $R^1$ is an alkyl group containing 4 to 22 carbon atoms, (G) is a sugar unit containing 5 or 6 carbon atoms, and p is a number of 1 to 10.

15. The lubricant of claim 14 wherein the alkyl oligoglycosides are derived from aldoses and/or ketoses.

16. An aqueous lubricant composition for use in the food and beverage industry comprising a diluted solution of the lubricant of claim 1 containing water, from about 0.01 to about 0.2% by weight of component A) plus component B), and from about 0.1 to about 1% by weight of component C).

17. A process for the lubrication, cleaning and/or disinfecting of chains, belts, machines, machine parts, or empty containers in the food and beverage industry, comprising contacting the foregoing with the aqueous lubricant composition of claim 16.

* * * * *